United States Patent [19]

Sakurai

[11] Patent Number: 5,035,524

[45] Date of Patent: Jul. 30, 1991

[54] INSTRUMENTS FOR APPLYING A LIQUID COATING INCLUDING A WRITING INSTRUMENT, A COSMETIC APPLICATOR OR SIMILAR DEVICES

[75] Inventor: Kiyokazu Sakurai, Kamiizumi, Japan

[73] Assignee: Mitsubishi Pencil Co., Ltd., Tokyo, Japan

[21] Appl. No.: 443,033

[22] Filed: Dec. 1, 1989

Related U.S. Application Data

[63] Continuation of Ser. No. 314,256, Feb. 24, 1989, abandoned, which is a continuation of Ser. No. 104,016, Oct. 5, 1987, abandoned.

[30] Foreign Application Priority Data

Oct. 6, 1986 [JP] Japan ..... 61-153504[U]

[51] Int. Cl.[5] ..... B43K 8/04

[52] U.S. Cl. ..... 401/206; 401/151; 401/273

[58] Field of Search ..... 401/206, 151, 99, 273

[56] References Cited

U.S. PATENT DOCUMENTS

| | | | |
|---|---|---|---|
| 1,185,760 | 6/1916 | Berry | 401/206 |
| 1,857,467 | 5/1932 | Marsh | 401/206 |
| 2,509,465 | 5/1950 | Wing | 401/151 |
| 3,211,346 | 10/1965 | Meshberg . | |
| 3,589,824 | 7/1971 | Andrews et al. | 401/206 |
| 4,043,681 | 8/1977 | Funahashi | 401/206 X |

FOREIGN PATENT DOCUMENTS

| | | | |
|---|---|---|---|
| 3303341 | 8/1984 | Fed. Rep. of Germany | 401/206 |
| 2517990 | 6/1983 | France . | |
| 2146588 | 4/1985 | United Kingdom . | |

*Primary Examiner*—Steven A. Bratlie

*Attorney, Agent, or Firm*—Armstrong, Nikaido, Marmelstein, Kubovcik & Murray

[57] ABSTRACT

A liquid coating instrument in which a coating liquid storage part or reservoir is provided in a shaft cylinder, a coating member is provided at the top of the shaft cylinder and a valve means is provided between the coating liquid storage part and the coating member. A chamber is provided between the valve and the coating liquid storage part. A means is provided that interrupts the communication between the chamber and the coating liquid storage part when knocking occurs and the chamber then comes into communication with the coating member, interrupting the communication between the chamber and the coating member when knocking is over and the chamber again communicates with the coating liquid storage part. Thus, only a maximum volume of the coating liquid, that is stored in the chamber, can be supplied to the coating member.

3 Claims, 2 Drawing Sheets

INSTRUMENTS FOR APPLYING A LIQUID COATING INCLUDING A WRITING INSTRUMENT, A COSMETIC APPLICATOR OR SIMILAR DEVICES

This application is a continuation of application Ser. No. 314,256, filed Feb. 24, 1989, now abandoned, which was a continuation of application Ser. No. 104,016, filed on Oct. 5, 1987, now abandoned.

BACKGROUND OF THE INVENTION

1. Field of the Invention

The present invention relates to a liquid coating application instrument for writing or cosmetics, such as, a marking pen, a manicure liquid coating instrument, and more particularly, to a liquid coating instrument having a valve means for controlling the supply of coating liquid, said valve means being located between a coating liquid storage part and a coating liquid application member, together with an improved coating liquid supply control mechanism.

2. Prior Art

With liquid coating instruments known in the prior art, a liquid storage part is directly communicated with a coating member to which coating liquid is supplied when a valve means is opened. Therefore, when the valve stays open too long, the rate of supplying coating liquid to the coating member becomes excessive, or when air stored in the coating liquid storage part is inflated, due to ambient temperature rise, etc., the coating liquid is violently pushed out when the valve is opened while splashing liquid from the coating member. These defects were associated with conventional liquid coating instruments known in the prior art.

SUMMARY OF THE INVENTION

The present invention provides an improved liquid coating or application instrument for writing, cosmetics, etc., in which said liquid coating instrument is provided with a coating liquid storage part or reservoir in a shaft cylinder, a coating member at the top of said shaft cylinder and a valve means for controlling supply rates of the coating liquid between said coating liquid storage part and said coating application member. According to the principles of the present invention, a chamber is provided between the valve seat and forwardly, but isolatedly, from the coating liquid storage or reservoir in such a manner as to remain in communication with the coating member and the coating liquid reservoir. In addition, there is provided a means that blocks the direct communication between the chamber and the coating liquid reservoir when the chamber becomes in communication with the coating member, and when the chamber is in communication with the coating liquid reservoir, said means blocks the direct communication between the chamber and the coating member. Thus, when said means is opened once, the coating member is supplied with a maximum coating liquid volume that was stored in said chamber.

More preferably, said chamber is separately provided from the valve seat towards the coating liquid storage part but separately from said coating liquid storage part or reservoir, in which a cylinder and a hole are equipped in the front and rear parts, respectively. Through said hole, a valve rod is inserted while communicating said chamber with the coating liquid storage part. Said valve rod is provided with a piston that can move in a sealed manner in said cylinder at a part close to the coating liquid storage part in the valve body, an extended cylindrical part that is located close to the coating liquid storage part and inserted in and sealing said hole. The length and position of said groove are formed in such a manner that, when the piston of the valve rod is located in the cylinder, said groove is disposed in said hole and allows communication between said valve chamber and coating liquid storage part through said groove. From a period immediately before the piston of the valve rod moves outside the cylinder and while the piston is located outside the cylinder, said groove is not engaged with the hole, and said hole is sealed with the valve rod thus terminating the communication between said chamber and the coating liquid storage part.

The coating liquid reservoir, a valve means and a chamber may be provided as parts of a cartridge, an element which has been included in the principal components of the present invention, but may be an alternate to this embodiment if a freely detachable cartridge is desirable.

DETAILED DESCRIPTION AND PREFERRED EMBODIMENT OF THE INVENTION

Figure 1:
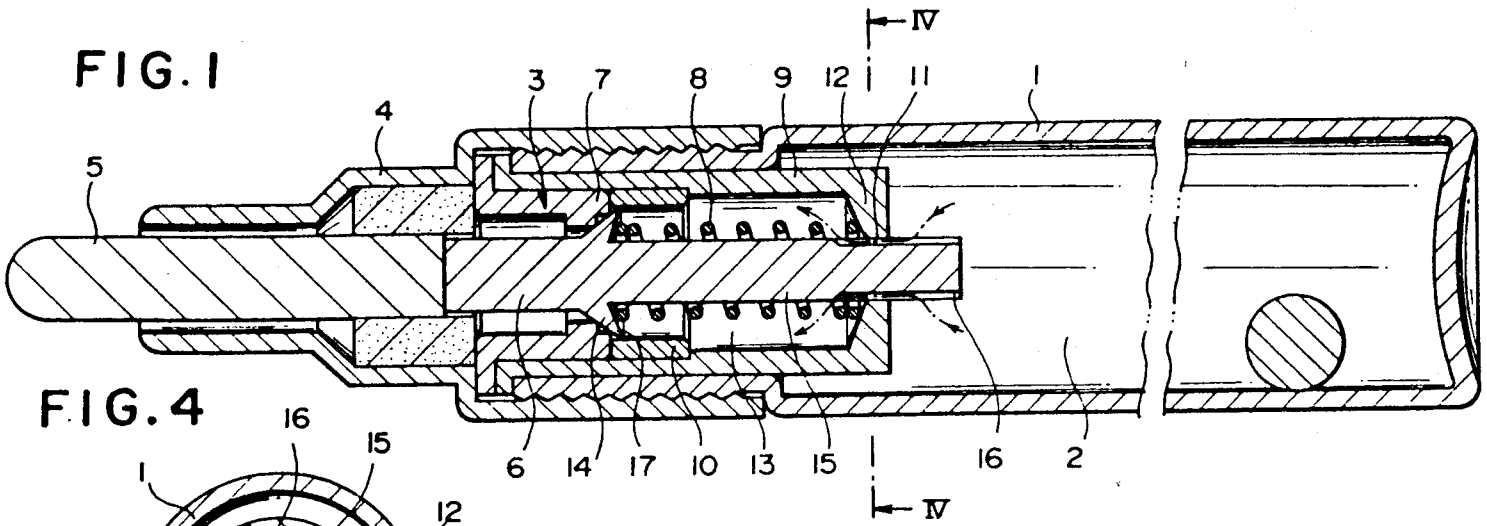
FIG. 1 is a sectional view at the center of a marking pen according to the present invention.
Figure 4:
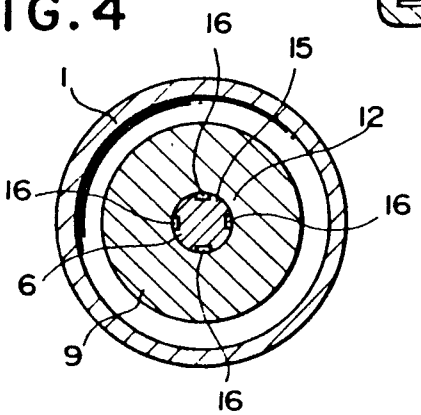
FIG. 4 is a sectional view of line IV—IV in FIG. 1.

The present invention will be detailed in the following paragraphs referring to the drawings for showing a marking pen according to the present invention.

In the drawings, 1 shows a shaft cylinder of a marking pen. Most of its interior forms a coating liquid storage reservoir, namely an ink tank 2.

The front end of said shaft cylinder 1 is opened and, at its opening part, a valve means 3 and a chamber 13 are provided.

At the front end of said shaft cylinder 1, a top cylinder 4 is threadedly mounted on the shaft cylinder 1. Said top cylinder 4 is provided with a coating application member, namely tip 5, mounted for axial movement therein. Said tip 5 is movable back and forth axially during the knocking operation. The rear end of said tip 5 engages with the top end of a valve rod 6 of a valve means. Valve rod 6 moves in conjunction with the movement of the tip 5 while opening or closing the valve means.

Valve means 3 basically comprises valve rod 6, valve seat member 7 and a valve spring, namely coil spring 8.

Valve rod 6 is normally urged towards the tip 5 by means of coil spring 8 located between the rear part of valve body 14 and the inner surface of the rear wall 12 of the chamber 13, while the valve body 14 is seated in normal conditions.

The top of an extended part in the valve rod 6, on the front side of the valve body 14, engages with the rear end of tip 5. Thus, the valve rod 6 is driven back and opened by moving the tip 5 backwardly overcoming the force of coil spring 8.

The valve body 14 also acts as a piston 17 that can move in a liquid tight fashion in the bore of the cylinder 10, due to the flared periphery. According to this embodiment, the valve body 14 and the piston 17 are formed integrally but could be constructed separately and secured together for movement with the valve rod 6.

The length of the cylinder 10 influences the length of groove 16 in the periphery of the valve rod 6, therefore determining the axial stroke of the valve rod 6 from the beginning of the valve rod 6 and moving backwardly to the shutoff of communication between the ink tank 2 and the chamber 13. However, the cylinder length does not relate to the ink supply nor to the rate per time. Consequently, the length of the cylinder 10 will not give advantageous or disadvantageous effects to the scope of the present invention, although an excessively long or short cylinder 10 is not preferable. The supply rate of ink per time is determined by the volume of the chamber 13.

The valve rod 6 is slidably mounted in a hole 11 drilled at the rear end of the chamber 13. At the rear end of the valve rod 6, four grooves 16 of a constant length are provided at equal angular intervals.

The length of this groove 16 is set up in such a manner that when the piston 17 is located in the cylinder 10, the groove partially enters the hole 11 for communicating the interior of the chamber 13 with the ink tank 2 through the groove 16, and from the time immediately before the piston 17 moves outside the cylinder 10 and as long as the piston 17 is not engaged with the cylinder 10, said groove 16 is also disengaged from said hole 11 while said hole 11 is hermetically sealed with a part of the valve rod 6, where there is no groove 16; thus shutting off the interior of the chamber 13 from the ink tank 2. Therefore, the chamber 13 is never in communication simultaneously with the tip 5 and the ink tank 2. Instead, the chamber 13 can communicate only with either the tip 5 or the ink tank 2 at the same time. However, immediately before the piston 17 is disengaged with the cylinder 10, the chamber 13 does not communicate with either tip 5 or ink tank 2.

According to this embodiment, the ink tank 2 is defined by the shaft cylinder 1 itself, while constructing the entire liquid coating instrument. Another construction is possible. The ink tank 2 may comprise a cartridge, another member having a valve means 3 and the chamber 13 structured in a similar manner, and thus the ink cartridge alone can be made a detachable part.

The action of the marking pen with this embodiment is described below.

First referring to FIG. 1, the tip 5 is in non-knocked state, when the valve body 14 of the valve rod 6 is seated on a valve seat member 7 by the force of the coil spring 8. Thus, the piston 17 is located at the extreme front end of the cylinder 10 while the groove 16 at the rear end is partially engaging with the hole 11 of the chamber 13 for communicating the chamber 13 with the ink tank 2. At that time, ink stored in the ink tank 2 cannot normally enter or leave the chamber 13. The tip 5 and the chamber 13 are not in communication by means of the cylinder 10 and the piston 17, because the valve body 14 is in contact with the valve seat 7 and the valve is closed.

Figure 2:
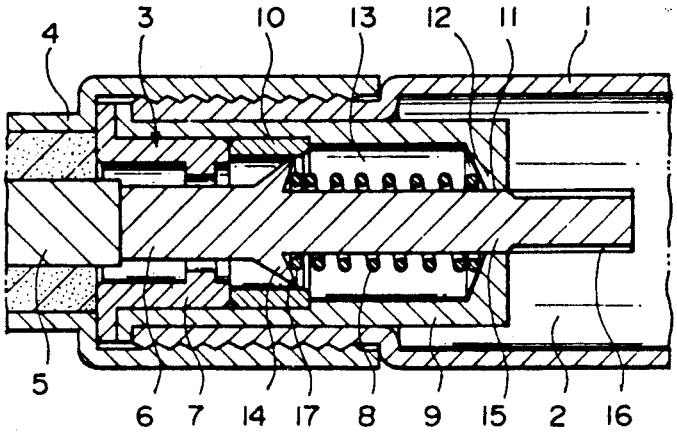
FIGS. 2 and 3 show sectional views of a center part in the marking pen of FIG. 1.

When the tip 5 is knocked from the state above due to a knocking action by moving the tip 5 axially, it backwardly overcomes the force of the coil spring, as is shown in FIG. 2. At that time, immediately before the piston 17 leaves the cylinder 10, the groove 16 at the rear end of the valve rod 6 is also disengaged from the hole 11 towards the interior of the ink tank 2, and thereby the communication between the interior of the chamber 13 and the ink tank 2 is shut off.

Figure 3:
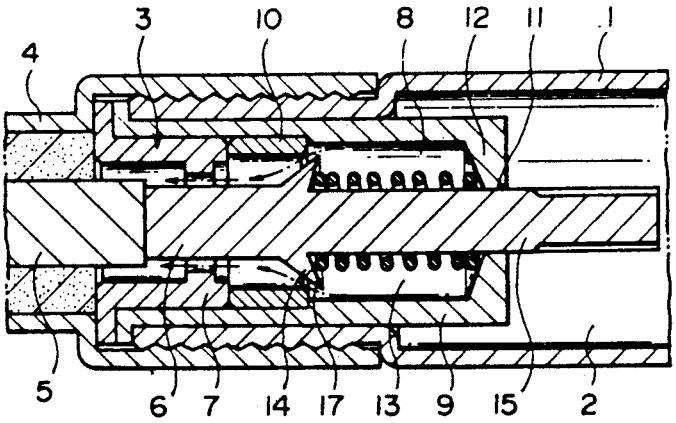

When the tip 5 is driven further backwardly, as is shown in FIG. 3, the piston 17 leaves the cylinder 10 while the interior of the chamber 13 is in communication with the tip 5, the hole 11 is maintained still watertight due to the valve rod 6 sealing the hole 11. Thus, a volume of ink, temporarily stored in the chamber 13, is supplied to the tip 5.

When the tip 5 is released from a pushing force after the above, the valve rod 6 is driven forwardly by the force of the coil spring 8, resuming the state shown in FIG. 1.

In this manner, a volume of ink that is supplied to the tip 5 by one-time supply work, namely knocking operation, is only that contained in the chamber 13 a time period from the knocking operation to the complete closure of the ink tank 2 side. No more ink is supplied to the tip 5 unless the knocking operation of the tip 5 is repeated.

Therefore, it never occurs that ink is supplied in excess unwillingly or splashed due to inflated air.

What is claimed is:

1. A liquid coating instrument for use as a writing instrument, a cosmetic applicator, or similar instrument which comprises:

(a) a shaft cylinder;

(b) a liquid storage part disposed in said cylinder in the rear portion thereof;

(c) a liquid coating applicator tip slidably mounted in said shaft cylinder at the front thereof;

(d) a chamber in said shaft cylinder between said liquid storage part and a valve unit to measure a predetermined quantity of liquid;

(e) a valve unit in said shaft cylinder to place said chamber in communication with said applicator tip;

(f) a spring means resiliently urging the valve unit to closed position;

(g) means for operating said valve unit so that when the valve unit is open to allow flow of liquid from said chamber to said liquid coating applicator tip, communication between the liquid storage part and the chamber is cut off; and (h) a second means activated by depressing said applicator tip to open said valve unit and place said chamber in communication with said applicator tip to feed only a predetermined amount of liquid to said applicator tip at a time when there is no communication between said storage part and said chamber.

2. A liquid coating instrument as claimed in claim 1, wherein a valve rod is slidably mounted in said shaft cylinder extending through said shaft cylinder from the rear of the liquid coating applicator tip into said chamber and has a flared valve body between said chamber and a valve seat of said valve unit, with said spring means urging said valve body against said valve seat; and wherein said means for operating said valve unit includes a rearwardly extending portion of said valve rod adapted to interrupt communication between said storage part and said chamber upon depression of said applicator tip.

3. A liquid coating instrument as claimed in claim 2, wherein said second means to feed only a predetermined amount of liquid to said applicator tip includes a cylinder positioned in said chamber and having a diameter sized to be substantially the same as a diameter of said valve body and a length of less than a length of said rearwardly extending portion of said valve rod such that said valve body acts as a piston in said cylinder supplying a volume of liquid to said applicator tip while said rearwardly extending portion of said valve rod interrupts communication between said storage part and said chamber.

* * * * *